US007305207B2

(12) United States Patent
Murakami et al.

(10) Patent No.: US 7,305,207 B2
(45) Date of Patent: Dec. 4, 2007

(54) CLEANING SYSTEM

(75) Inventors: Susumu Murakami, Soraku-gun (JP); Yoshie Iwakura, Higashiosaka (JP); Kuniaki Nakano, Soraku-gun (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 269 days.

(21) Appl. No.: 11/062,609

(22) Filed: Feb. 22, 2005

(65) Prior Publication Data

US 2005/0180785 A1 Aug. 18, 2005

(30) Foreign Application Priority Data

Feb. 23, 2004 (JP) ..... 2004-046542

(51) Int. Cl.
*G03G 15/16* (2006.01)

(52) U.S. Cl. ..... 399/297; 399/327; 399/343; 399/350

(58) Field of Classification Search ..... 399/297, 399/302, 308, 327, 343, 350; 15/256.5, 256.51
See application file for complete search history.

(56) References Cited

U.S. PATENT DOCUMENTS 4,367,690 A * 1/1983 Sakaguchi et al. ..... 118/60
6,405,015 B1 * 6/2002 Suzuki ..... 399/350
6,463,253 B2 * 10/2002 Sato ..... 399/350
6,690,905 B2 * 2/2004 Takahashi et al. ..... 399/302
7,085,528 B2 * 8/2006 Shintani et al. ..... 399/350
7,127,201 B2 * 10/2006 Takenouchi et al. ..... 399/297

FOREIGN PATENT DOCUMENTS

| | | | |
|---|---|---|---|
| JP | 4-362680 A | | 12/1992 |
| JP | 5-307346 | * | 11/1993 |
| JP | 8-137298 A | | 5/1996 |
| JP | 2002-62740 A | | 2/2002 |
| JP | 2002-148958 A | | 5/2002 |
| JP | 2002-278308 A | | 9/2002 |

* cited by examiner

*Primary Examiner*—Hoan Tran
(74) *Attorney, Agent, or Firm*—Birch, Stewart, Kolasch & Birch, LLP

(57) ABSTRACT

A cleaning system includes a rotating member and a cleaning blade which is forced against a curved outer surface of the rotating member to scrape off matter to be removed (toner) which is present along the outer surface of the rotating member. The cleaning blade has greater hardness than the outer surface of the rotating member.

9 Claims, 8 Drawing Sheets

CLEANING SYSTEM

CROSS REFERENCE

This Nonprovisional application claims priority under 35 U.S.C. § 119(a) on Patent Application No. 2004-046542 filed in Japan on Feb. 23, 2004, the entire contents of which are hereby incorporated by reference.

BACKGROUND OF THE INVENTION

The present invention relates to a cleaning system including a cleaning blade for scraping off matter to be removed from an outer surface of a rotating member.

An image forming apparatus is provided with a photosensitive drum, an intermediate transfer belt, a fuser roller and a cleaning system, for example. A toner image is formed on an outer surface of the photosensitive drum based on an electrostatic latent image which is formed from image data input into the image forming apparatus. The toner image formed on the photosensitive drum is transferred onto the intermediate transfer belt. The toner image transferred onto the intermediate transfer belt is then transferred onto a sheet of printing paper and fused, or fixed, thereto by the fuser roller. The cleaning system removes residual toner left on such rotating members as the photosensitive drum and the intermediate transfer belt to prevent deterioration of image quality in succeeding processes.

FIG. 1 is a structural diagram schematically showing an example of a conventional cleaning system including a cleaning blade 103. As depicted in FIG. 1, an endless belt 101 is mounted over a rigid rotating body (photosensitive drum) 102. As the cleaning blade 103 having flexibility is pressed toward a cylindrical outer surface of the rotating body 102 with the endless belt 101 passing in between, the cleaning blade 103 scrapes off matter to be removed, i.e., residual toner, left on an outer surface of the turning endless belt 101. If the cleaning blade 103 which scrapes across the endless belt 101 turning on the rigid rotating body 102 is an element made of a rigid material, the cleaning blade 103 will damage the endless belt 101. For this reason, the hardness of the cleaning blade 103 is made lower than that of the outer surface of the rotating body 102. Therefore, a tip end of the cleaning blade 103 could be crushed by a pushing force applied thereto against the outer surface of the rotating body 102.

FIGS. 2A to 2D are explanatory diagrams showing how the conventional cleaning system works. Forced in tight contact with the outer surface of the endless belt 101, the cleaning blade 103 scrapes and collects toner powder adhering to the outer surface of the endless belt 101 as shown in FIG. 2A. The tip end of the cleaning blade 103 is pulled in a turning direction (clockwise direction as illustrated) of the rotating body 102 due to a frictional force exerted between the endless belt 101 and the cleaning blade 103 as shown in FIG. 2B. When the frictional pulling force exerted on the cleaning blade 103 by the endless belt 101 in the turning direction of the rotating body 102 exceeds a limit of buckling strength of the cleaning blade 103, the tip end of the cleaning blade 103 bounces back due to its resilience and flips off the cumulated toner powder as shown in FIG. 2C, and then the cleaning blade 103 returns to an original position as shown in FIG. 2D. The cleaning blade 103 removes the residual toner while repeatedly producing the aforementioned action due to a so-called stick-slip phenomenon.

Therefore, the conventional cleaning system is associated with a problem that surrounding areas of the cleaning blade 103 are apt to be contaminated with the toner powder scattered around by the stick-slip phenomenon. Furthermore, since great pressure is applied to the cleaning blade 103, the tip end of the cleaning blade 103 tends to wear or be cut away. The outer surface of the endless belt 101 with which the cleaning blade 103 is forced in tight contact is likely to wear or be abraded. In addition, the pressing cleaning blade 103 is prone to cause meandering of the endless belt 101.

If the endless belt 101 exerts too large a friction force on the cleaning blade 103, the tip end of the cleaning blade 103 would occasionally become bent in an opposite direction as shown by broken lines in FIG. 3. When the tip end of the cleaning blade 103 is bent in the opposite direction as illustrated, the cleaning blade 103. will not be able to remove the toner. Typically, a slip agent 104 made of fine spherical plastic particles is applied to the outer surface of the endless belt 101 as shown in FIG. 4 in the conventional cleaning system. The slip agent 104 serves to prevent such backward bending of the cleaning blade 103 as mentioned above (FIG. 3). In addition, fine particles of an external additive 106 made of silica and magnetite are attached to an outer surface of each toner particle 105.

Each particle of the slip agent 104 is approximately 0.3 micrometers in diameter while each particle of the external additive 106 has a diameter smaller than that of the slip agent 104. Since the outer surface of the rotating body 102, against which the cleaning blade 103 forces the endless belt 101, has a surface roughness of approximately 50 micrometers, the particles of both the slip agent 104 and the external additive 106 pass through a gap between the rotating body 102 and the cleaning blade 103.

The particles of the slip agent 104 and the external additive 106 passing between the rotating body 102 and the cleaning blade 103 act as abrasive material, which accelerates wear of the endless belt 101 against which the cleaning blade 103 is tightly pressed. In a case where the cleaning system is used for cleaning a photosensitive drum, those particles of the slip agent 104 and the external additive 106 applied to each toner particle 105 which have passed between the photosensitive drum and the tip end of the cleaning blade 103 would adhere to a charging wire for electrostatically charging the photosensitive drum, thereby causing uneven tones of a printed image.

An example of a cleaning system employing a cleaning blade is found in Japanese Patent Application Publication No. 1992-362680. The Publication discloses an arrangement for preventing backward bending of the cleaning blade which is pressed against an image transfer belt with the aid of an elastic reinforcing plate which has higher stiffness than the cleaning blade and is disposed in contact with the cleaning blade on a rear side thereof.

Another example of a cleaning system employing a cleaning blade is found in Japanese Patent Application Publication No. 2002-148958. This Publication also discloses an arrangement for preventing deformation (backward bending) of the cleaning blade. In this arrangement, an image transfer belt has a double-layer structure including a base layer having high flexibility and a surface layer formed by heat-bonding a plastic film to the base layer to provide improved lubricity between the cleaning blade and the image transfer belt.

The aforementioned prior art arrangements disclosed in Japanese Patent Application Publication Nos. 1992-362680 and 2002-148958 are approaches to preventing backward bending of the cleaning blade. Accordingly, neither of these arrangements prevents the aforementioned problems of the prior art, such as contamination of the surrounding areas of the cleaning blade 103 by the toner powder scraped off and scattered around, wear or cutting of the tip end of the cleaning blade 103, wear of the endless belt 101 and uneven tones of a printed image caused by those particles of the slip agent 104 and the external additive 106 which have passed between the photosensitive drum and the tip end of the cleaning blade 103.

SUMMARY OF THE INVENTION

It is an object of the invention to provide a cleaning system which can remove fine particles, such as toner powder, and prevent scattering of the removed particles. It is another object of the invention to provide a cleaning system of which cleaning blade can be used for an extended period of time.

According to the invention, a cleaning system includes a rotating member and a cleaning blade. Forced against a curved outer surface of the rotating member, the cleaning blade slides along the outer surface of the rotating member and scrapes off matter to be removed which is present along the outer surface of the rotating member. The cleaning blade has greater hardness than the outer surface of the rotating member. Since the hardness of the cleaning blade is higher than that of the rotating member, the cleaning blade can scrape off the matter to be removed without producing the stick-slip phenomenon.

These and other objects of the invention will become more readily apparent from the following description when read in conjunction with accompanying drawings.

DETAILED DESCRIPTION OF THE INVENTION

Specific embodiments of the invention are now described with reference to the accompanying drawings.

Figure 1:
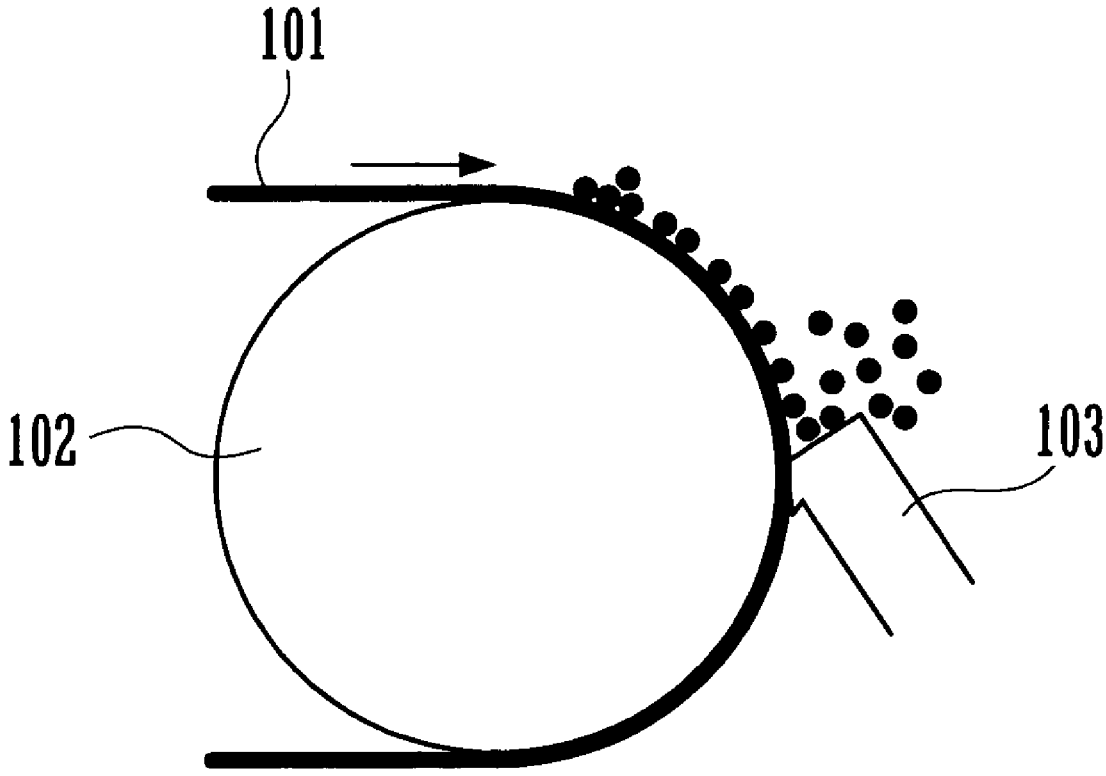
FIG. 1 is a structural diagram schematically showing a conventional cleaning system.
Figure 2A:
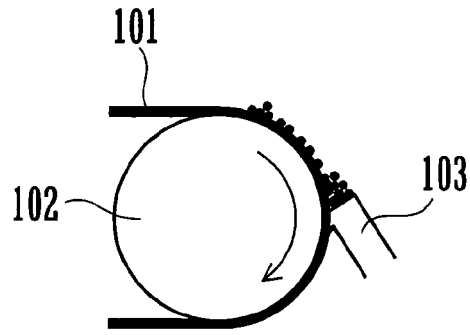
FIGS. 2A, 2B, 2C and 2D are explanatory diagrams showing how the conventional cleaning system works.
Figure 2B:
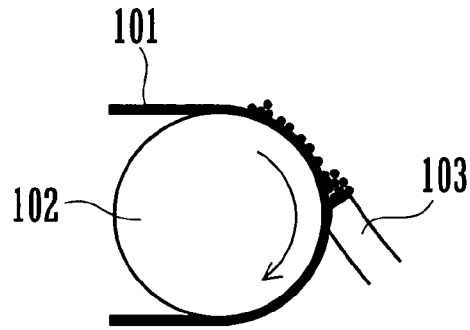
Figure 2C:
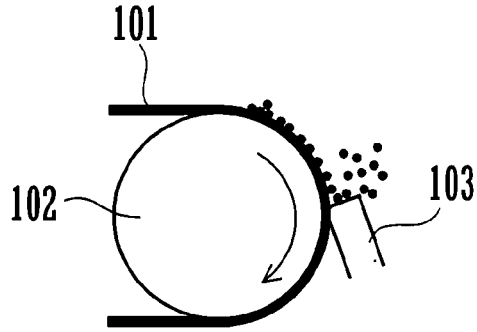
Figure 2D:
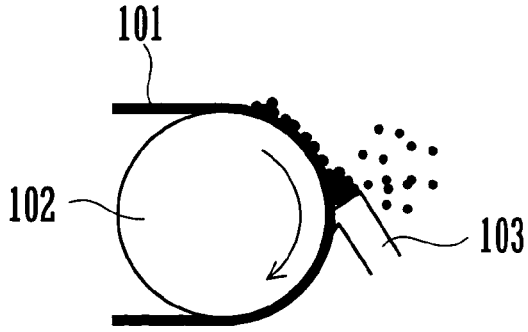
Figure 3:
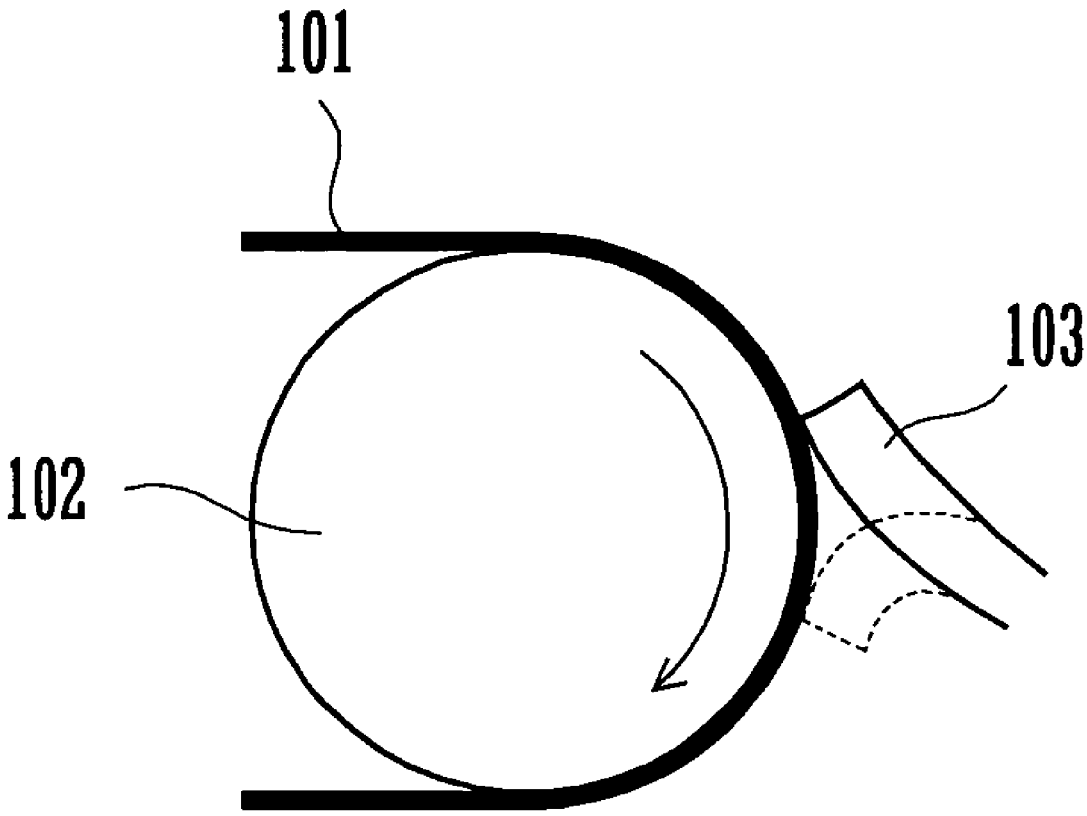
FIG. 3 is an explanatory diagram showing a situation in which a cleaning blade of the conventional cleaning system has become bent in an opposite direction.
Figure 4:
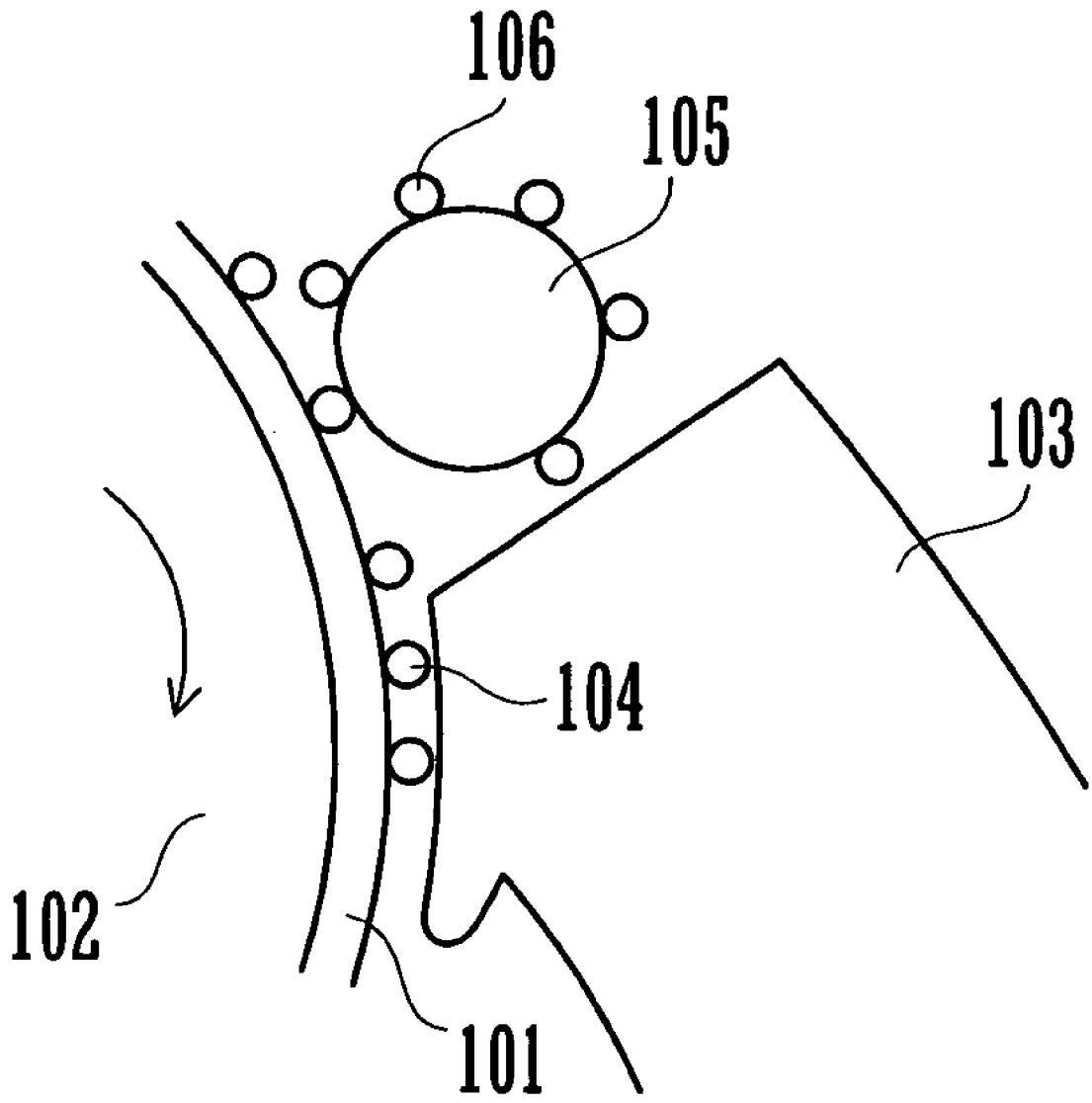
FIG. 4 is an enlarged view particularly showing a portion where the cleaning blade of the conventional cleaning system presses against a rotating body.
Figure 5:
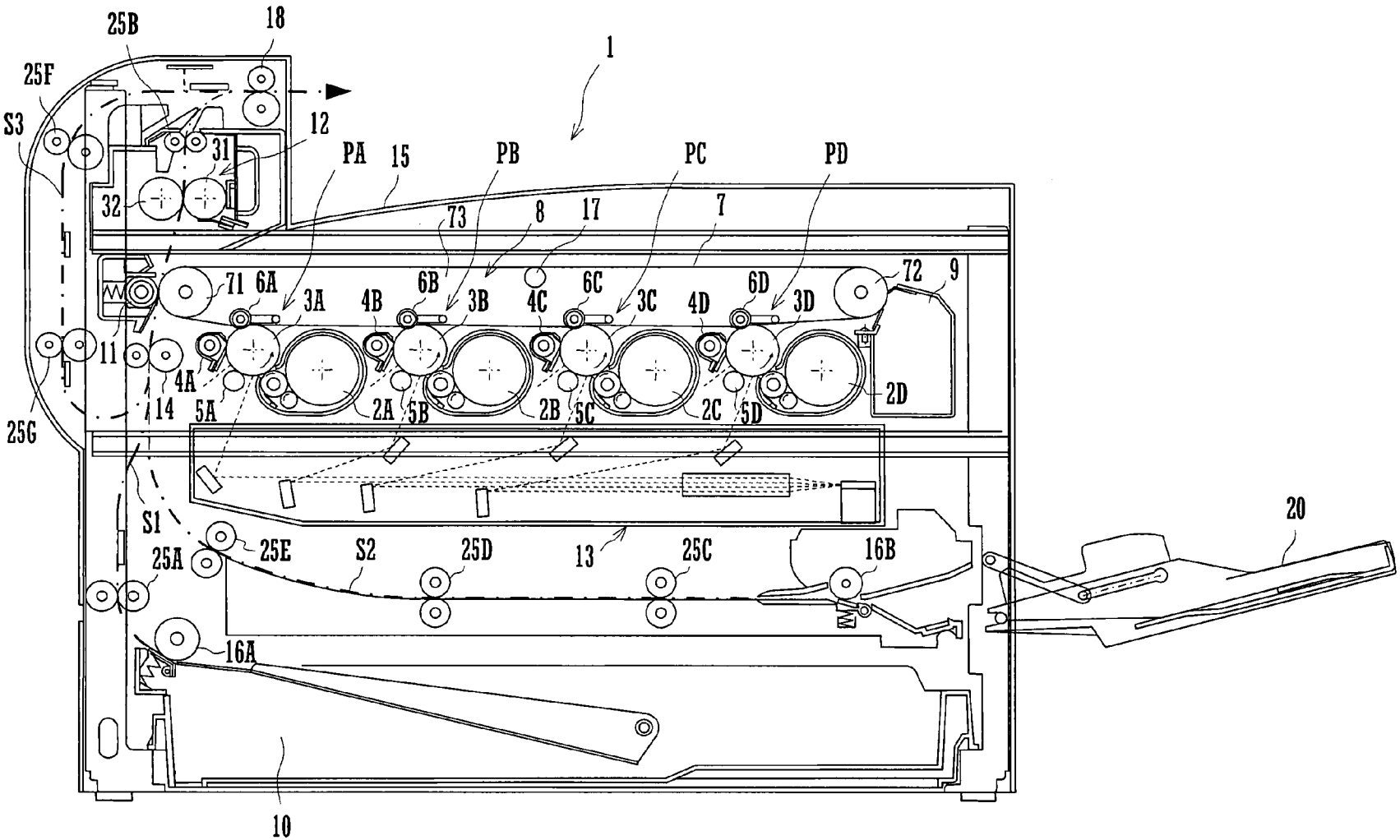
FIG. 5 is a sectional diagram schematically showing the structure of an image forming apparatus employing a cleaning system according to an embodiment of the invention.

FIG. 5 is a sectional diagram schematically showing the structure of an image forming apparatus 1 employing a cleaning system according to a preferred embodiment of the invention. Having a full-color mode and a monochrome mode, the image forming apparatus 1 including the cleaning system of the embodiment forms multicolor or monochrome images on sheets of a recording medium, such as printing paper, according to externally supplied image data. To perform such image forming operation, the image forming apparatus 1 includes an exposure unit 13, four photosensitive drums 3A to 3D serving as image carrying members, four charging rollers 5A to 5D, four developing units 2A to 2D, four cleaning units 4A to 4D, an intermediate image transfer belt (endless belt) 7, four primary image transfer rollers 6A to 6D, a secondary image transfer roller 11, a fuser unit 12, sheet transport paths S1, S2 and S3, a paper cassette 10, a manual feed tray 20 and a delivery tray 15.

The photosensitive drum 3A, the charging roller 5A, the developing units 2A and the cleaning unit 4A together constitute an image forming section PA. Similarly, the photosensitive drum 3B, the charging roller 5B, the developing units 2B and the cleaning unit 4B together constitute an image forming section PB. The photosensitive drum 3C, the charging roller 5C, the developing units 2C and the cleaning unit 4C together constitute an image forming section PC. The photosensitive drum 3D, the charging roller 5D, the developing units 2D and the cleaning unit 4D together constitute an image forming section PD.

The four image forming sections PA, PB, PC, PD perform image forming operation by using image data corresponding to black, cyan, magenta and yellow, respectively. The image forming sections PA, PB, PC, PD are arranged in line along a turning direction (sub-scanning direction) of the intermediate image transfer belt 7.

The charging rollers 5A to 5D are contact-type charging devices for uniformly charging cylindrical outer surfaces of the photosensitive drums 3A to 3D to a specified potential level. As an alternative, contact charging devices using charging brushes or noncontact charging devices using charging wires may be employed instead of the charging rollers 5A to 5D.

Including a semiconductor laser, a polygon mirror and reflecting mirrors which are not illustrated, the exposure unit 13 projects laser beams based on the image data corresponding to the four colors (black, cyan, magenta, yellow) upon the respective photosensitive drums 3A to 3D. As a result, latent images carrying black, cyan, magenta and yellow components are formed on the outer surfaces of the photosensitive drums 3A to 3D, respectively, according to the image data for the four color components.

The developing units 2A to 2D store black, cyan, magenta and yellow toners, respectively, and supply these toners onto the outer surfaces of the photosensitive drums 3A to 3D to convert the respective latent images into toner images of the individual colors (including black). The cleaning units 4A to 4D remove and collect residual toners left on the outer surfaces of the respective photosensitive drums 3A to 3D upon completion of a toner image transfer process.

There is provided an image transfer unit 8 above the photosensitive drums 3A to 3D. The image transfer unit 8 includes the intermediate image transfer belt 7, a driving roller 71, a driven roller (rotating member) 72, a tension roller 17, the primary image transfer rollers 6A to 6D and a cleaning unit 9 for cleaning the intermediate image transfer belt 7.

The intermediate image transfer belt 7 is an endless belt measuring 75 to 150 micrometers thick. Mounted between the driving roller 71 and the driven roller 72, the intermediate image transfer belt 7 turns in the clockwise direction as illustrated in FIG. 5. The photosensitive drum 3D, the photosensitive drum 3C, the photosensitive drum 3B and the photosensitive drum 3A are arranged in this order along the turning direction of the intermediate image transfer belt 7, facing from below an outer surface of the intermediate image transfer belt 7 at a bottom half thereof.

The primary image transfer rollers 6A to 6D are located face to face with the photosensitive drums 3A to 3D, respectively, with the bottom half of the intermediate image transfer belt 7 passing in between. Each of the primary image transfer rollers 6A to 6D includes a round bar made of a metallic material, such as stainless steel, measuring 8 to 10 millimeters in diameter of which curved outer surface is covered with an electrically conductive elastic material, such as ethylene-propylene-diene terpolymer (EPDM) or urethane foam. As an alternative, brush-shaped intermediate image transfer members may be used instead of the primary image transfer rollers 6A to 6D.

An image transfer bias (or electrostatic potential) of a polarity opposite to that of a static charge (negative in this embodiment) given to the toners is applied to the primary image transfer rollers 6A to 6D, while the intermediate image transfer belt 7 is uniformly charged to a high voltage by means of an electrically conductive elastic member. With this arrangement, the color toner images formed on the individual photosensitive drums 3A to 3D are successively transferred one on top of another onto the outer surface of the intermediate image transfer belt 7 to produce a full-color toner image on the outer surface of the intermediate image transfer belt 7.

If image data for only part of the four color components (black, cyan, magenta, yellow) has been input, however, the latent image(s) and the toner image(s) are formed only on the photosensitive drum(s), among the four photosensitive drums 3A to 3D, for which the image data has been input. When the monochrome mode is selected, for example, the latent image and the toner image are formed only on the photosensitive drum 3A for black and only the black toner image is transferred onto the outer surface of the intermediate image transfer belt 7.

As the intermediate image transfer belt 7 turns, the toner image formed on the outer surface of the intermediate image transfer belt 7 as discussed above is brought to a position facing the secondary image transfer roller 11. While the image forming apparatus 1 is performing the image forming operation, the secondary image transfer roller 11 is pressed against the outer surface of the intermediate image transfer belt 7 with a specified level of nipping pressure. When a sheet of printing paper fed from the paper cassette 10 or the manual feed tray 20 passes between the secondary image transfer roller 11 and the driving roller 71, a high voltage of a polarity (positive in this embodiment) opposite to that of the static charge (negative in this embodiment) given to the toners is applied to the secondary image transfer roller 11. As a result, the toner image is transferred from the outer surface of the intermediate image transfer belt 7 onto a surface of the sheet.

To maintain the specified level of nipping pressure between the secondary image transfer roller 11 and the intermediate image transfer belt 7, one of the secondary image transfer roller 11 and the driving roller 71 is made of a rigid material (e.g., metal) while the other is an elastic roller made of an elastic material (e.g., rubber or plastic foam).

Located at a position facing the driven roller 72 via the intermediate image transfer belt 7, the cleaning unit 9 removes and collects unused masses of the toners transferred from the photosensitive drums 3A to 3D onto the intermediate image transfer belt 7, that is, residual toner powder left on the intermediate image transfer belt 7 without being transferred onto the sheet of printing paper. The cleaning unit 9 working in this way serves to prevent color mixing in a succeeding image forming job. In this embodiment, the cleaning system of this invention is implemented as a system for removing the residual toner remaining on the intermediate image transfer belt 7 as will be later discussed in further detail.

The sheet on which the toner image has been transferred is guided to the fuser unit 12 which includes a heat roller 31 and a pressure roller 32. Pressing against each other with a specific pushing force, the heat roller 31 and the pressure roller 32 rotate together while squeezing the sheet in between. As the heat roller 31 and the pressure roller 32 apply heat and pressure to the sheet, the toner image is firmly fixed, or fused, onto the surface of the sheet. Then, the sheet carrying the fused toner image is discharged onto the delivery tray 15 by a pair of transport rollers 25B and a pair of delivery rollers 18

The image forming apparatus 1 has the aforementioned sheet transport path S1 which extends generally vertically for successively feeding sheets of printing paper stored in the paper cassette 10 upward between the secondary image transfer roller 11 and the intermediate image transfer belt 7 and through the fuser unit 12 onto the delivery tray 15.

Along this sheet transport path S1, there are provided a pickup roller 16A for pulling and feeding each successive sheet into the sheet transport path S1 out of the paper cassette 10, transport rollers 25A for feeding the sheet pulled out of the paper cassette 10 upward along the sheet transport path S1, a pair of registration rollers 14 for temporarily halting the sheet transported along the sheet transport path S1 and advancing the sheet with proper timing to a secondary image transfer area B (see FIG. 6) located between the secondary image transfer roller 11 and the intermediate image transfer belt 7, as well as the aforementioned transport rollers 25B and delivery rollers 18 for ejecting the sheet onto the delivery tray 15.

Also formed inside the image forming apparatus 1 is the aforementioned sheet transport path S2 extending from the manual feed tray 20 to the registration roller pair 14. There are provided a pickup roller 16B and pairs of transport rollers 25C, 25D and 25E along the sheet transport path S2. Further, the aforementioned sheet transport path S3 is formed in the image forming apparatus 1 between the registration roller pair 14 and the delivery roller pair 18 with pairs of transport rollers 25F and 25G provided along the sheet transport path S3.

The delivery rollers 18 are supported rotatably in both forward and reverse turning directions. In a single-sided image forming mode in which an image is formed on only one side of a sheet, the image forming apparatus 1 causes the delivery rollers 18 to turn in the forward turning direction to eject the sheet onto the delivery tray 15 when the image has been printed on one side of the sheet. In a duplex (double-sided) image-forming mode in which first and second images are formed on front and reverse sides of a sheet, respectively, the image forming apparatus 1 causes the delivery rollers 18 to turn in the forward turning direction to eject the sheet onto the delivery tray 15 when the second image has been printed on the reverse side of the sheet.

When printing the first image on the front side of the sheet in the duplex image-forming mode, on the other hand, the image forming apparatus 1 causes the delivery rollers 18 to turn in the forward turning direction until a trailing edge of the sheet passes between the transport rollers 25B. Then, when the delivery rollers 18 nip the trailing edge of the sheet, the image forming apparatus 1 causes the delivery rollers 18 to turn in the reverse turning direction to guide the sheet into the sheet transport path S3. Consequently, the sheet carrying the first image printed on one side (front side) only is guided back into the sheet transport path S1 with the front and reverse sides, and leading and trailing edges, of the sheet reversed.

The registration rollers 14 advance the sheet fed from the paper cassette 10 or the manual feed tray 20, or fed back into the sheet transport path S1 through the sheet transport path S3, to the secondary image transfer area B located between the secondary image transfer roller 11 and the intermediate image transfer belt 7 with specific timing. Specifically, the registration rollers 14 halt in a standby state while gripping the leading edge of the sheet just before the intermediate image transfer belt 7 begins to turn again. The registration rollers 14 are caused to begin rotating again with such timing that the leading edge of the sheet aligns with a forward end of the toner image formed on the intermediate image transfer belt 7 (more exactly a leading edge of an image forming area on the intermediate image transfer belt 7) at the secondary image transfer area B where the secondary image transfer roller 11 presses against the intermediate image transfer belt 7.

Figure 6:
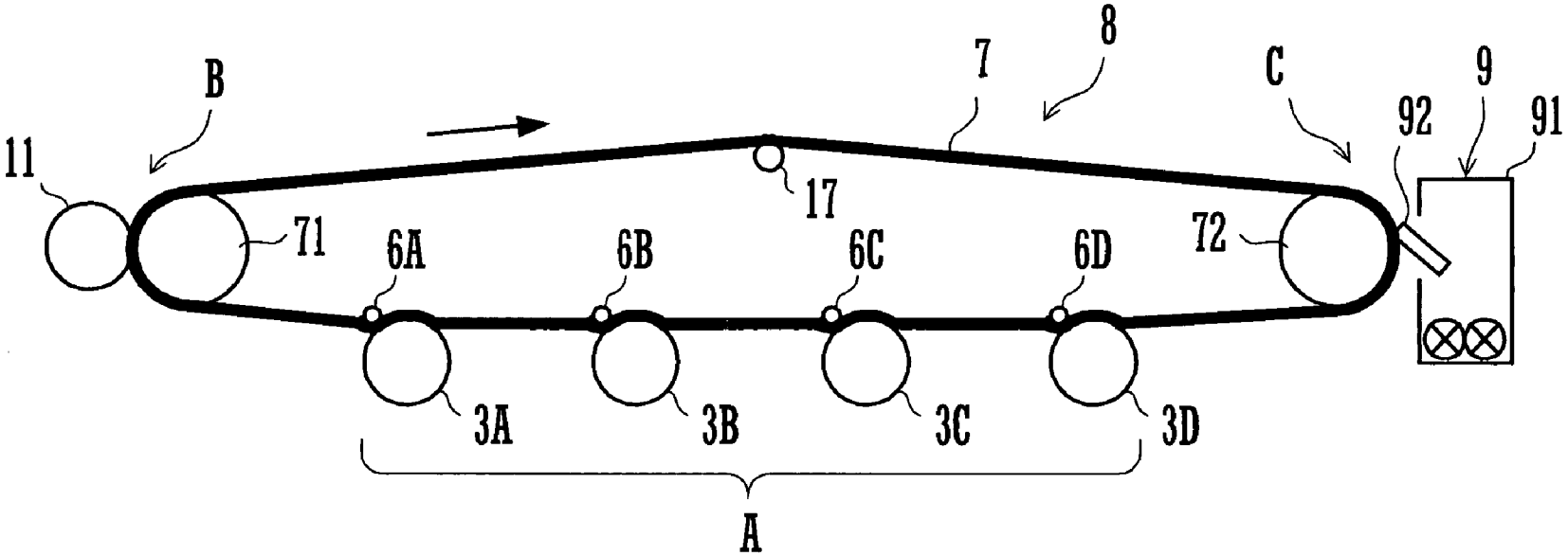
FIG. 6 is a schematic diagram showing an image transfer unit and a cleaning unit of the embodiment.

FIG. 6 is a schematic diagram showing the image transfer unit 8 and the cleaning unit 9. The intermediate image transfer belt 7 is mounted generally horizontally between the driving roller 71 and the driven roller 72. The intermediate image transfer belt 7 moves along a looping path which passes through a primary image transfer area A where the color toner images formed on the individual photosensitive drums 3A to 3D are transferred therefrom onto the outer surface of the intermediate image transfer belt 7, the aforementioned secondary image transfer area (nearby area of the driving roller 71) B where the toner image transferred onto the intermediate image transfer belt 7 is transferred onto a sheet of printing paper between the secondary image transfer roller 11 and the driving roller 71, and a nearby area C of the driven roller 72 where the intermediate image transfer belt 7 is pulled by the driven roller 72.

In this embodiment, the primary image transfer roller 6A is positioned in such a manner that the center of a contact area between the primary image transfer roller 6A and the intermediate image transfer belt 7 is located on a downstream side of the center of a contact area between the photosensitive drum 3A and the intermediate image transfer belt 7 with respect to the turning direction of the intermediate image transfer belt 7. The other primary image transfer rollers 6B to 6D are also positioned in a similar way relative to the respective photosensitive drums 3B to 3D. It is to be noted, however, that arrangement of the primary image transfer rollers 6A to 6D and the photosensitive drums 3A to 3D is not limited to this relationship in their locations.

The tension roller 17 is forced against an inner surface of the intermediate image transfer belt 7 as illustrated in FIG. 6 to produce a specific tension acting upward from inside on the intermediate image transfer belt 7 between the secondary image transfer area B and the nearby area C of the driven roller 72 in the looping path of the intermediate image transfer belt 7.

The cleaning unit 9 is located at the position facing the driven roller 72 with the intermediate image transfer belt 7 in between as mentioned earlier. The cleaning unit 9 includes a housing 91 and a cleaning blade 92.

Figure 7:
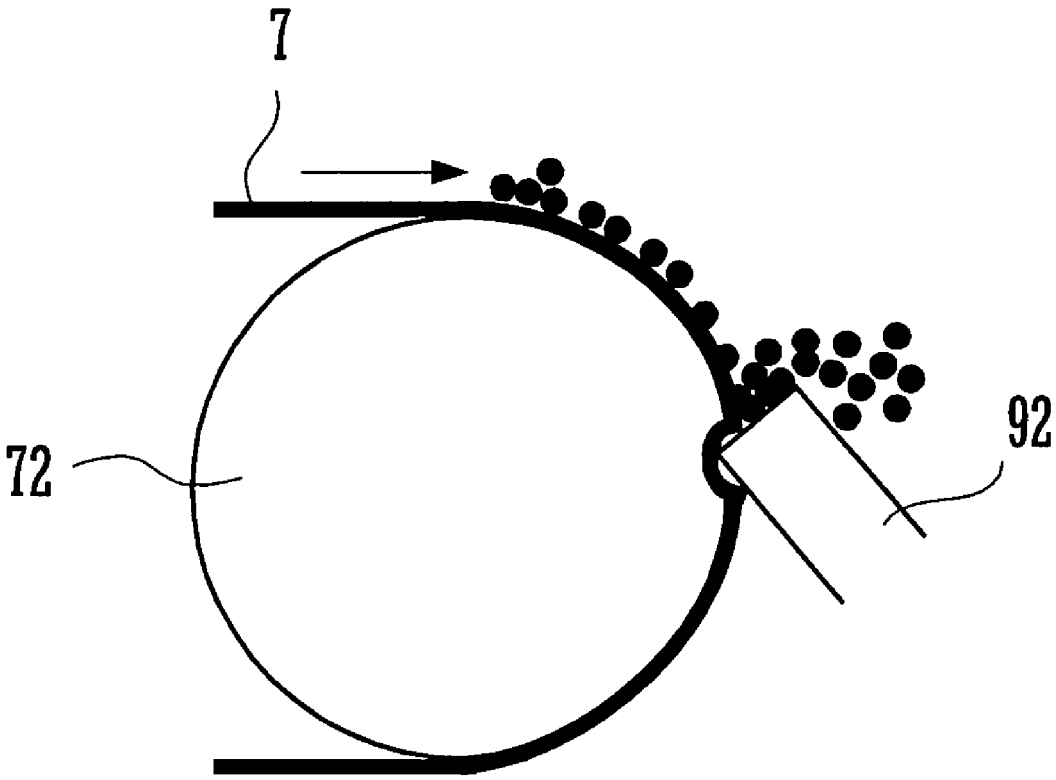
FIG. 7 is an enlarged view of a nearby area of a driven roller.

FIG. 7 is an enlarged view of the nearby area C of the driven roller 72. The driven roller 72 pulls the intermediate image transfer belt 7 at one end. As illustrated in FIG. 7, the residual toner powder left on the intermediate image transfer belt 7 after a toner image transfer process at the secondary image transfer area B remains attached to the outer surface of the intermediate image transfer belt 7. The cleaning blade 92 is forced against a cylindrical outer surface of the driven roller 72 at an acute angle with the intermediate image transfer belt 7 passing in between. A tip end of the cleaning blade 92, or a scraping edge of the cleaning blade 92 which is held in contact with the intermediate image transfer belt 7, has a surface layer made of fluoroplastic to give enhanced lubricity to the tip end of the cleaning blade 92.

The tip end of the cleaning blade 92 has greater hardness than the outer surface of the driven roller 72. In this embodiment, the tip end of the cleaning blade 92 has a hardness of 70 or above as measured according to the Japanese Industrial Standard (JIS) Asker C hardness scale. Preferably, the hardness of the tip end of the cleaning blade 92 is 75 to 80. The outer surface of the driven roller 72 has an Asker C hardness of 65 or less, more preferably, 45 to 55.

In this structure, the cleaning blade 92 maintains its shape without deforming when pressed against the outer surface of the driven roller 72. When pressed by the cleaning blade 92, a contact area of the outer surface of the driven roller 72 forced by the cleaning blade 92 becomes slightly recessed due to a pushing force exerted by the cleaning blade 92. When the tip end of the cleaning blade 92 presses the outer surface of the driven roller 72 in this fashion, the cleaning blade 92 can scrape off the residual toner powder from the intermediate image transfer belt 7 without producing the earlier-mentioned stick-slip phenomenon.

When pressed by the cleaning blade 92, a portion of the outer surface of the driven roller 72 forced by the cleaning blade 92 is depressed by approximately 0.1 mm in the direction of a central axis of the driven roller 72 due to the pushing force exerted by the cleaning blade 92. Since the driven roller 72 has a surface roughness of approximately 50 micrometers, the outer surface of the driven roller 72 is pushed in by the pushing force of the cleaning blade 92 by an amount larger than the surface roughness of the driven roller 72. Thus, when the cleaning blade 92 presses the outer surface of the driven roller 72, the portion of the outer surface of the driven roller 72 forced by the cleaning blade 92 becomes generally a geometrically flat region without creating conspicuous furrows or ridges. Accordingly, the intermediate image transfer belt 7 is forced by the cleaning blade 92 against this geometrically almost flat region of the outer surface of the driven roller 72 and, therefore, matter adhering to the intermediate image transfer belt 7, such as the residual toner left thereon, can not pass through a gap between the intermediate image transfer belt 7 and the cleaning blade 92 but is scraped off by the cleaning blade 92. Even if a slip agent is applied to the outer surface of the intermediate image transfer belt 7 or fine particles of an external additive are attached to an outer surface of each toner particle, such substances constituting matter to be removed are scraped off by the cleaning blade 92.

Furthermore, because the tip end of the cleaning blade 92 is covered with a fluoroplastic layer for enhanced lubricity, it is no longer absolutely necessary to apply a slip agent to the outer surface of the intermediate image transfer belt 7.

Even when the cleaning blade 92 is forced against the driven roller 72, the tip end of the cleaning blade 92 does neither crush nor produce the stick-slip phenomenon. This serves to significantly suppress wear and cutting away of the scraping edge of the cleaning blade 92 which is held in contact with the driven roller 72, thereby extending the useful life of the cleaning blade 92.

As the cleaning blade 92 scrapes off the residual toner from the outer surface of the intermediate image transfer belt 7 without producing the stick-slip phenomenon, it is possible to suppress scattering of the toner powder and minimize contamination of surrounding areas of the cleaning blade 92 with the toner powder.

Furthermore, since the driven roller 72 has flexibility which allows the driven roller 72 to become recessed when forced by the cleaning blade 92, the intermediate image transfer belt 7 is not damaged by the pushing force exerted by the cleaning blade 92. In addition, the cleaning blade 92 is not so hard as metal but has proper flexibility and the tip end of the cleaning blade 92 has enhanced lubricity. This further ensures that the intermediate image transfer belt 7 would not be damaged by the pushing force exerted by the cleaning blade 92.

Moreover, the enhanced lubricity of the tip end of the cleaning blade 92 serves to reduce frictional force between the cleaning blade 92 and the intermediate image transfer belt 7. Also, the cleaning blade 92 is formed to have a specific degree of stiffness, making it possible to prevent the cleaning blade 92 from bending in an opposite direction. Accordingly, the cleaning blade 92 of the embodiment can remove the residual toner powder and other contaminants whatever left on the outer surface of the intermediate image transfer belt 7 in a reliable fashion.

The cleaning system of the present embodiment thus far described may be implemented as a cleaning system for removing residual toner from the heat roller 31 or the pressure roller 32 of the fuser unit 12 for fusing the toner image onto a sheet of printing paper. In this varied form of the embodiment, a cleaning blade is forced against the heat roller 31 or the pressure roller 32. Since the cleaning blade of this variation does not produce the stick-slip phenomenon either, scattering of the toner is prevented in the same fashion as discussed above. In this variation of the embodiment, the heat roller 31 or the pressure roller 32 corresponds to a fuser roller referred to in the appended claims.

Figure 8:
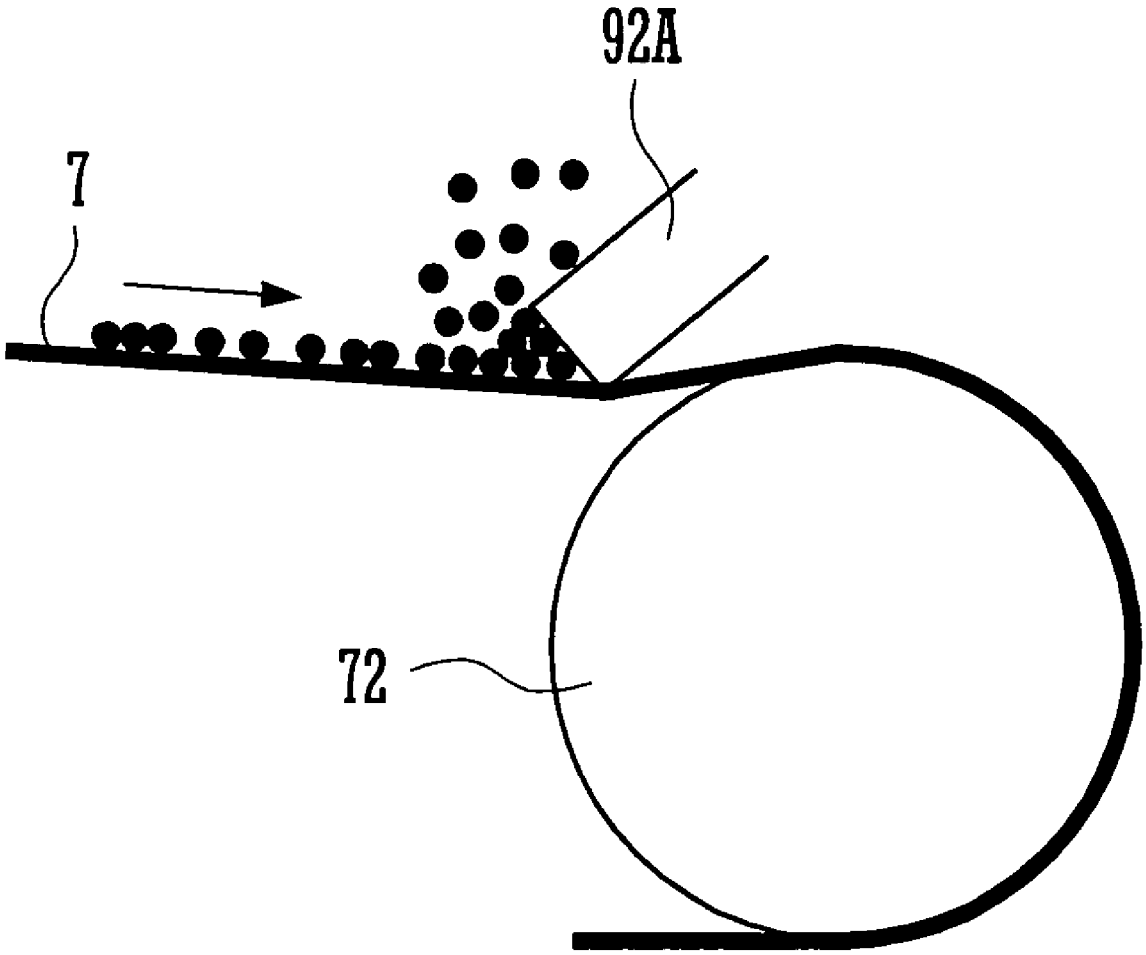
FIG. 8 is a sectional diagram schematically showing the structure of a cleaning system according to another embodiment of the invention.

FIG. 8 is a sectional diagram schematically showing the structure of a cleaning system according to another embodiment of the invention. In this embodiment, the intermediate image transfer belt 7 is suspended between the driving roller 71 and the driven roller 72 as well. Residual toner powder constituting matter to be removed remains attached to the outer surface of the intermediate image transfer belt 7 after a toner image transfer process at the secondary image transfer area B. A cleaning blade 92A of this embodiment is forced against a portion of the outer surface of the intermediate image transfer belt 7 where the intermediate image transfer belt 7 is not supported from its inside surface by the driving roller 71, the driven roller 72, the tension roller 17, or else. The cleaning blade 92A is forced against the outer surface of the intermediate image transfer belt 7 at an acute angle. In this embodiment, the cleaning blade 92A is located apart from but in close proximity to the driven roller 72 as illustrated in FIG. 8. Since the cleaning blade 92A is located so close to the driven roller 72 where the driven roller 72 does not flutter too much that the cleaning blade 92A removes the residual toner on the intermediate image transfer belt 7 in a reliable fashion.

The cleaning blade 92A may press against the intermediate image transfer belt 7 at any appropriate location within a range from the secondary image transfer area B to the nearby area C of the driven roller 72 in the looping path of the intermediate image transfer belt 7. Preferably, however, the cleaning blade 92A presses against the intermediate image transfer belt 7 at a convenient location within a range from the secondary image transfer area B to the nearby area C of the driven roller 72. More preferably, the cleaning blade 92A presses against the intermediate image transfer belt 7 at a location in close proximity to one of the driving roller 71, the driven roller 72 and the tension roller 17 around which the intermediate image transfer belt 7 is mounted.

As in the foregoing embodiment, a tip end of the 92A has a hardness of 70 or above, preferably 75 to 80, as measured by the JIS Asker C hardness scale. Therefore, the cleaning blade 92A retains its shape without deforming when pressed against the outer surface of the intermediate image transfer belt 7. The tip end of the cleaning blade 92A, or a scraping edge of the cleaning blade 92A which is held in contact with the intermediate image transfer belt 7, also has a surface layer made of fluoroplastic to give enhanced lubricity to the tip end of the cleaning blade 92A.

When pressed by the cleaning blade 92A, a portion of the intermediate image transfer belt 7 forced by the cleaning blade 92A becomes displaced in the direction of a normal to the forced portion of the intermediate image transfer belt 7, or in the direction perpendicular to the outer surface of the intermediate image transfer belt 7, due to a pushing force exerted by the cleaning blade 92A. The amount of this displacement is approximately 0.5 millimeters. There exists no mechanical part located to face the cleaning blade 92A via the intermediate image transfer belt 7 when the intermediate image transfer belt 7 is forced by the cleaning blade 92A. Therefore, the intermediate image transfer belt 7 is not damaged as a result of depression by the cleaning blade 92A even if there exists foreign matter adhering to the inside surface of the intermediate image transfer belt 7.

The cleaning blade 92A forced against the intermediate image transfer belt 7 scrapes off the residual toner powder and other contaminants whatever left on the outer surface of the intermediate image transfer belt 7 while sliding along the outer surface of the intermediate image transfer belt 7. As the cleaning blade 92A scrapes off the residual toner from the outer surface of the intermediate image transfer belt 7 without producing the stick-slip phenomenon, it is possible to prevent scattering of the toner powder and minimize contamination of surrounding areas of the cleaning blade 92A with the toner powder.

In one variation, the cleaning system of the invention may be applied to an image forming apparatus employing an endless-belt-type photosensitive member. In this variation, the cleaning system is adapted to scraping off residual toner powder from the endless-belt-type photosensitive member. Specifically, a cleaning blade of this cleaning system is forced via the photosensitive member against-an outer surface of a roller (rotating member) on which the photosensitive member is mounted. Alternatively, the cleaning blade presses against a portion of an outer surface of the photosensitive member where the photosensitive member is not supported from its inside surface by the roller with the cleaning blade held in contact with the photosensitive member at an acute angle. The cleaning blade of the cleaning system of this variation and the alternative thereof can scrape off the residual toner powder from the photosensitive member and prevent scattering of the toner powder without producing the stick-slip phenomenon. Furthermore, since this cleaning system can also remove fine particles of such material as a slip agent and an external additive attached to toner particles, it is possible to prevent the slip agent from adhering to a charging wire and suppress deterioration of image quality.

Furthermore, the cleaning blades 92, 92A of the aforementioned embodiments may be modified such that the cleaning blades 92, 92A contain fluoroplastic not only in their surface layers but the cleaning blades 92, 92A are formed in their entirety of a material containing fluoroplastic.

The invention being thus described, it will be obvious that the same may be varied in many ways. Such variations are not to be regarded as a departure from the spirit and scope of the invention, and all such modifications as would be obvious to one skilled in the art are intended to be included within the scope of the invention.

What is claimed is:

1. A cleaning system comprising:

a rotating member; and a cleaning blade which is forced against a curved outer surface of said rotating member to scrape off matter to be removed which is present along the outer surface of said rotating member, said cleaning blade having greater hardness than the outer surface of said rotating member such that the outer surface of the rotating member becomes a substantially flat region when the cleaning blade is forced against the outer surface of the rotating member.

2. The cleaning system according to claim 1, wherein said cleaning blade has stiffness high enough to maintain an original shape when forced against said rotating member, and said rotating member has flexibility which allows a portion of the outer surface of said rotating member pressed by said cleaning blade to become recessed due to a pushing force exerted by said cleaning blade.

3. The cleaning system according to claim 1, wherein at least a pushing part of said cleaning blade contains fluorine.

4. The cleaning system according to claim 1, wherein said rotating member suspends an endless belt under tension and said cleaning blade is forced against the outer surface of said rotating member via said endless belt to scrape off the matter to be removed which is present along an outer surface of said endless belt.

5. The cleaning system according to claim 1, wherein said rotating member suspends under tension an endless-belt-type photosensitive member having an outer surface on which a toner image is created from an electrostatic latent image which is formed based on differences in electrostatic potential imparted to the outer surface of said photosensitive member, and said cleaning blade is forced against the outer surface of said rotating member via said photosensitive member to scrape off the matter to be removed which is present along the outer surface of said photosensitive member.

6. The cleaning system according to claim 1, wherein said rotating member is a fuser roller for firmly fixing a toner image loosely adhering to a recording medium onto the recording medium.

7. A cleaning system comprising:

an endless belt having an outer surface to which matter to be removed adheres;

a roller device which suspends and turns said endless belt under tension; and a cleaning blade which is forced against a portion of the outer surface of said endless belt where said endless belt is not supported from an inside surface thereof by said roller device, said cleaning blade being located proximate to the roller device, said cleaning blade having stiffness high enough to maintain an original shape when forced against said endless belt;

wherein said endless belt turns under conditions in which a portion of said endless belt forced by said cleaning blade becomes displaced in the direction of a normal to said forced portion of said endless belt due to a pushing force exerted by said cleaning blade.

8. The cleaning system according to claim 7, wherein said roller device includes a driving roller and a driven roller, said endless belt turns along a looping path which passes through a primary image transfer area where a toner image is transferred onto said endless belt from an image carrying member, a nearby area of said driving roller where the toner image is transferred onto a recording medium and a nearby area of said driven roller in this order, and said cleaning blade presses against said endless belt at a particular location within a range from the nearby area of said driving roller to the nearby area of said driven roller in the looping path of said endless belt.

9. The cleaning system according to claim 7, wherein said endless belt is an endless-belt-type photosensitive member having an outer surface on which a toner image is created from an electrostatic latent image which is formed based on differences in electrostatic potential imparted to the outer surface of said photosensitive member, and said cleaning blade is forced against the outer surface of said roller device via said photosensitive member to scrape off the matter to be removed which is present along the outer surface of said photosensitive member.

* * * * *